US005922408A

United States Patent [19]

Nakama et al.

[11] Patent Number: 5,922,408

[45] Date of Patent: Jul. 13, 1999

[54] COATING METHOD USING EXTRUSION DIE HAVING PREDETERMINED GAP

[75] Inventors: Yutaka Nakama, Tokyo; Eiten Chin, Ichigai-machi, both of Japan

[73] Assignee: Kao Corporation, Tokyo, Japan

[21] Appl. No.: 08/833,353

[22] Filed: Apr. 4, 1997

[30] Foreign Application Priority Data

Apr. 12, 1996 [JP] Japan ..... 8-114357

[51] Int. Cl.[6] ..... B05D 3/12

[52] U.S. Cl. ..... 427/356; 118/411

[58] Field of Search ..... 427/356; 118/411

[56] References Cited

U.S. PATENT DOCUMENTS 4,854,262 8/1989 Chino et al. ..... 118/411
5,167,713 12/1992 Watanabe ..... 118/411
5,418,004 5/1995 Chin et al. ..... 427/356

FOREIGN PATENT DOCUMENTS 63-88080 4/1988 Japan .
2-251265 10/1990 Japan .

*Primary Examiner*—Katherine A. Bareford
*Attorney, Agent, or Firm*—Oblon, Spivak, McClelland, Maier & Neustadt, P.C.

[57] ABSTRACT

A first downstream lip 25 and a second downstream lip 26 are formed with coating work surfaces 34, 35 facing a web 21 and making contact with coating liquid 22A, 22B, a ratio h/G between a gap G defined between the downstream end X of the coating work surface of the first downstream lip and the web. A film thickness h of a lower layer coating film 33A which is extruded from a fist slot part 27 located upstream from the first downstream lip, and which has not yet been dried, is set in the following range:

$$0.4<h/G<0.5.$$

4 Claims, 7 Drawing Sheets

COATING METHOD USING EXTRUSION DIE HAVING PREDETERMINED GAP

BACKGROUND OF THE INVENTION

1. Field of the Invention

The present invention relates to a coating method, and in particular to a suitable coating method using an extrusion type coating device (extrusion dies, which will be hereinbelow denoted simply as "dies") suitable for forming a multi-layer coating film on a base material.

2. Discussion of the Background

Conventionally, it is known to extrude multiple coating liquids onto a base material to form a multi-layer coating film on the base material using an extrusion-type coating device (such inventions as disclosed in Japanese Laid-Open Patent (JP-A) No. 63-88080 and No. 2-251265).

According to this conventional technology, one upstream lip and two or more downstream lips are incorporated in a coating apparatus that has a plurality of slots formed between these lips; coating liquid can be extruded through the slots. The coating liquid may be of the same or different in composition and is extruded, through respective slot parts, onto a base material fed in a first direction from the upstream lip toward the downstream lips. Thereby, the liquid coated on the base material at the upstream slots is overcoated by the other liquid at the downstream slots. In this way, a coating film of multi-layer structure is formed on the base material.

FIG. 5 is a sectional view showing a condition in which a two-layer coating film is formed by a coating device 1 comprising an upstream lip 2, a first downstream lip 3 and a second downstream lip 4, and a first slot part 5 defined between the upstream lip 2 and the first downstream lip 3, and a second slot part 6 defined between the first downstream lip 3 and the second downstream lip 4. Coating liquid 7 for the lower layer extruded from the first slot part 5 and coating liquid 8 for the upper layer extruded from the second slot part 6 form a coating film 10 having a two-layer structure composed of a lower coating film 10A and an upper coating film 10B on a web 9 as a base material.

However, even though such a conventional coating device as mentioned above is suitably used, a satisfactory coating film cannot be formed. In certain cases, streak-like unevenness is developed at equal pitches along the coating direction, and in other cases, relatively large width streak-like bright-and-dark unevenness caused by there even thickness is developed also along the coating direction.

Most of the prior art mentioned above has been concerned with the shape of the tip end of a lip (coating work surface), and in particular the curvature of a lip curved convexly toward the web. Japanese Laid-Open Patent (JP-A) No. 63-88080 discloses a process in which differences in the radii of curvature of the downstream lips is set in a predetermined range in order to obtain satisfactory coating, and specifically, a height difference between the lips is set in a range of −300 to +300 $\mu$m. However, in the coating conditions (such as a thickness of a coating film) stated in the embodiments disclosed in the Japanese Laid-Open Patent (JP-A) No. 63-88080, the height difference between the lips should actually be set in a more limited range.

In more detail, if the height difference between the downstream lips in the two-layer coating die is adjusted so that the ratio between the film thickness h of the lower coating film 10A which is extruded from the first slot part 5 and which is not yet dried, and a gap G defined between the downstream end of the coating work surface (lip surface) 11 of the first downstream lip 3 and the web 9, at the position a, is set as follows:

$$h/G>0.5,\ h/G<0.4$$

the coating film 10 becomes uneven.

That is, in the case of h/G>0.5, at least a part of an interface 12 at the boundary between the lower layer of coating liquid 7 and the upper layer of coating liquid 8, in the widthwise direction of the dies separates from the above-mentioned downstream end position a of the first downstream lip 3 in the direction A, as shown in FIG. 6A, and accordingly, meniscus unevenness is developed in the coating film 10 in the coating widthwise direction.

Further, in the case of h/G<0.4, an interface 12 between the lower layer of coating liquid 7 and the upper layer of coating liquid 8 separates from the downstream end position a of the first downstream 3 in the direction B as shown in FIG. 6B, and accordingly, relatively large width streak-like bright-and-dark unevenness caused by there even thickness or mottled unevenness is developed in the coating direction. It is noted that reference numeral f of FIG. 5 denotes the film thickness of the upper layer of coating film 10B which has not yet dried.

SUMMARY OF THE INVENTION

The present invention has been developed in view of the above-mentioned circumstance, and accordingly, an object of the present invention is to provide a coating method which can prevent the occurrence of unevenness in coating, and which can provide a coating film having a multi-layer structure and also having a satisfactory quality.

To the end, according to the present invention, there is provided a coating method using a coating device including an upstream lip, at least two downstream lips, and slot parts defined between the above-mentioned lips for extruding coating liquid for coating the above-mentioned coating liquid over a base material being fed in a first direction while facing the above-mentioned upstream and downstream lips. Each of the above-mentioned downstream lips is formed with a coating work surface which faces the above-mentioned base material and makes contact with the coating liquid. A ratio between a gap G between the downstream end of the coating work surface of any one downstream lips, other than the downstream-most lip, and the above-mentioned base material, and a thickness h of the film thickness of a coating film formed by the coating liquid held between the coating work surface at which the gap G is set and the base material, when separated from the coating device and in an undried condition, is set as follows:

$$0.4<h/G<0.5$$

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Explanation will be hereinbelow made of preferred embodiments of the present invention with reference to the drawings.

First Embodiment

Figure 1:
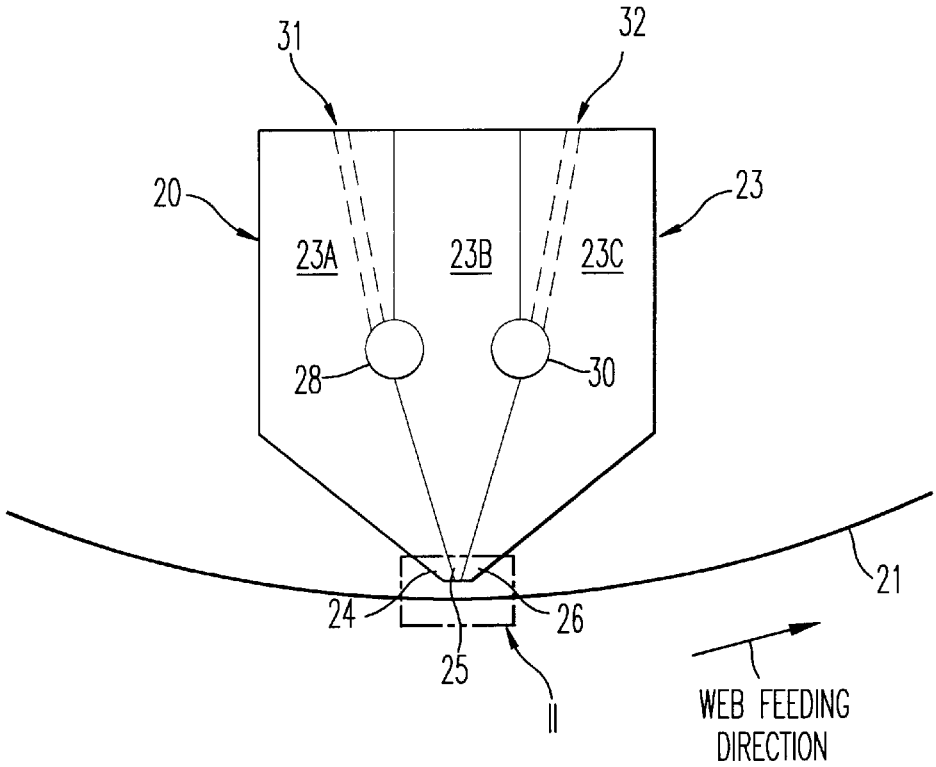
FIG. 1 is a schematic sectional view illustrating a die head to which a first embodiment of a coating device adapted to be used in a coating method according to the present invention is applied.
Figure 2:
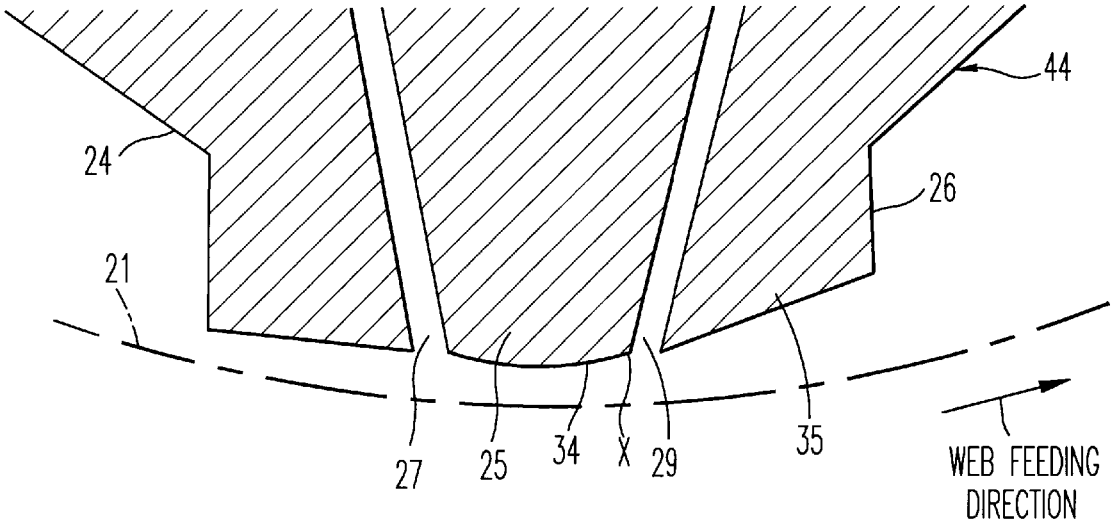
FIG. 2 is an enlarged sectional detail view illustrating II part in FIG. 1.

Referring now to the drawings, wherein like reference numerals designate identical or corresponding parts throughout the several views, a coating device 20 illustrated in FIGS. 1 and 2 is an extrusion-type coating device in which coating film is applied to a base material fed continuously to form a multi-layer coating film. The base material may be a flexible sheet or web made of plastic, paper, cloth or metal. The coating liquid may be magnetic dispersoid, light-sensitive liquid, heat-sensitive dispersoid or adhesive liquid to produce a magnetic recording medium, photographic film, heat-sensitive paper (including heat transfer type ink ribbon) or adhesive tape respectively. In the present embodiment, web 21 is used as the base material, and lower layer coating liquid 22A and upper layer coating liquid 22B are used as the coating liquids. The lower and upper layer coating liquids differ in component composition.

A coating device 20 has a die head 23 composed of an upstream block 23A, a first downstream block 23B and a second downstream block 23C. An upstream lip 24, a first downstream lip 25 and a second downstream lip 26 are formed, in the mentioned order in the feeding direction of a web 21, at the front end of the die head 23. The upstream lip 24 is formed at the tip end of the upstream block 23A, the first downstream lip 25 is formed at the tip end of the first downstream block 23B, and the second downstream lip 26 is formed at the tip end of the second downstream block 23C.

A first slot part 27 is formed between the upstream lip 24 and the first downstream lip 25. The first slot part 27 communicates with a first liquid chamber 28. A second slot part 29 is formed between the first downstream lip 25 and the second downstream lip 26. The second slot part 29 communicates with a second liquid chamber 30.

The widths of the upstream lip 24, the first downstream lip 25 and the second downstream lip 26 are set to be nearly equal to the width of the web 21. The first slot part 27 and the first liquid chamber 28 are constructed so as to extend along the whole of the widths of the upstream lip 24 and the first downstream lip 25. The second slot part 29 and the second liquid chamber 30 are constructed so as to extend along the whole of the widths of the first downstream lip 25 and the second downstream lip 26.

The first liquid chamber 28 is connected with a first liquid supply system 31. The lower layer coating liquid 22A from the first liquid supply system 31 is distributed so as to make the coating amount in the direction of coating width uniform and is supplied to the first slot part 27. The second liquid chamber 30 is connected with a second liquid supply system 32. The upper layer coating liquid 22B from the second liquid supply system 32 is distributed so as to make the coating amount in the direction of coating width uniform and is supplied to the second slot part 29.

Figure 3:
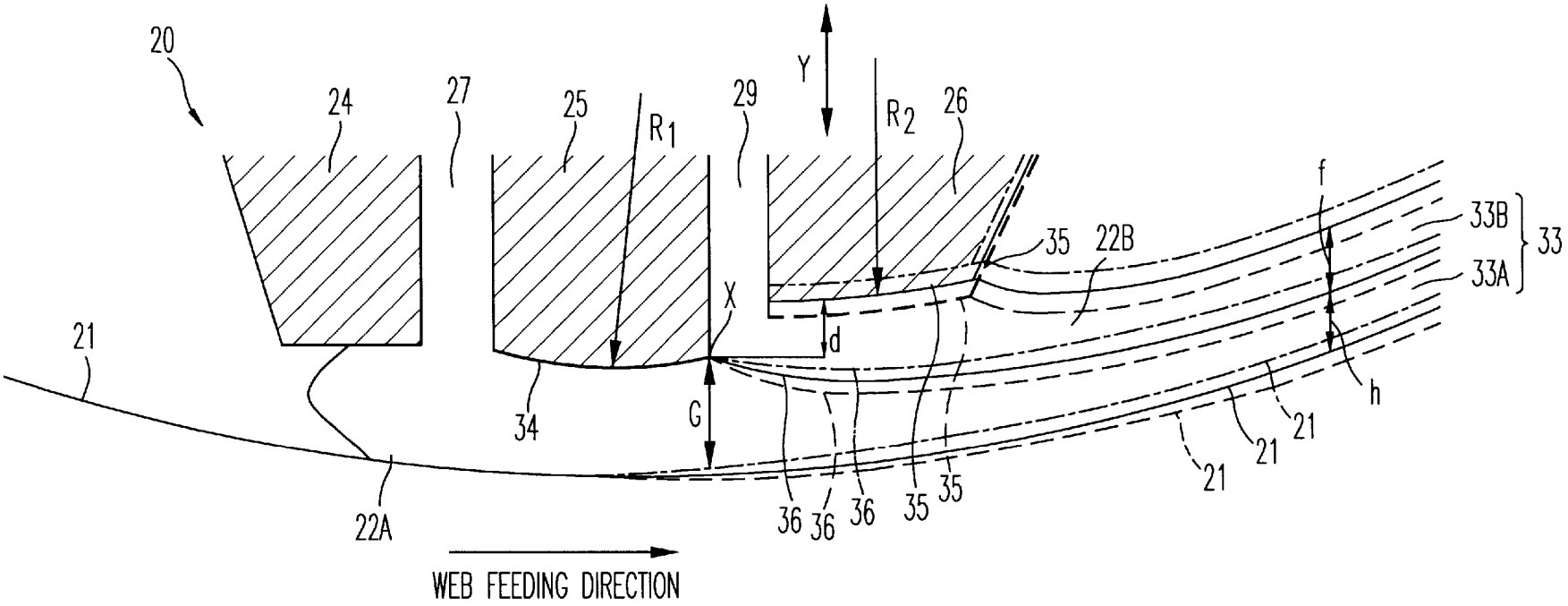
FIG. 3 is a sectional view illustrating the die head shown in FIG. 1 in a coating condition.

The web 21 is guided by guide rollers or other means (not shown) and fed in a first direction without being supported from the back surface in relation to the upstream lip 24, the first downstream lip 25 and the second downstream lip 26. In coating apparatus 20, as shown in FIG. 3, the lower layer coating liquid 22A from the first slot 27 and the upper layer coating liquid 22B from the second slot part 29 are successively and continuously extruded and coated onto feeding web 21; thereby, a multi-layer coating film 33 comprising lower coating film layer 33A and upper coating film layer 33B is formed with a uniform width in the direction of coating. Lower coating film layer 33A is composed of the lower layer coating liquid 22A, while upper coating film layer 33B is composed of the upper layer coating liquid 22B.

Coating work surfaces (lip surface) 34 and 35 at the front ends of the first and second downstream lips 25 and 26 respectively contact the lower layer coating liquid 22A and the upper layer coating liquid 22B at locations opposite web 21. Coating work surfaces 34 and 35 are convex toward web 21 or are flat.

In this coating device 20, a ratio h/G between a gap G defined in the second height direction, i.e., transverse to the feed direction, between a downstream end X of the first downstream lip 25 on the coating work surface 34, and the web 21, and a film thickness h of a lower layer coating film 33A, which has been extruded from the slot part 27 and has not yet dried, is set as follows:

$$0.4<h/G<0.5 \qquad \text{Form (1)}$$

Here, the film thickness h of the lower layer coating film 33A which has not yet dried is determined from an extruding flow rate of the lower layer liquid 22A from the first slot part 27, and a feeding speed and a width of the web 21. That is, it is calculated by $h=Q/(U\cdot W)$ where Q is a discharge volume of liquid per unit time, U is a feeding speed of the web, and W is a coating width of the web, and is set to a desired value in accordance with the kind of products being produced.

In this embodiment, the adjustment of h/G is made by moving the second downstream lip 26 in a direction Y toward and away from the web 21 so as to change a distance (height difference d) between the downstream end X of the first downstream lip 25 on the coating work surface 34 and upstream end of the second downstream lip 26 on the coating work surface 35 in order to displace the position of the web 21. Displacement of the position of the web 21 changes the gap G, as seen in FIG. 3. It is noted that reference numeral f in FIG. 3 is a film thickness of the upper layer coating film 33B which has not yet dried.

Table 1 represent the result of actual experiments in which the coating work surface 34 of the first downstream lip 25 and the coating work surface 35 of the second downstream lip 26 were arcuate surfaces. Further, the radii $R_1$, $R_2$ of curvature of the coating work surface 34 of the first downstream lip 25 and the coating work surface 35 of the second downstream lip 26 were set to 11 mm and 31 mm, respectively, the film thickness of the upper and lower layer coating films were set to 0.3 $\mu$m and 1.2 $\mu$m, respectively, and the coating speed was set to 100 m/sec. As there shown, when the height difference d was set to 0 $\mu$m, 1 $\mu$m or 3 $\mu$m, h/G was in a range from 0.44 to 0.50 so that an interface 36 between the lower layer coating liquid 22A and the upper layer coating liquid 22B was stabilized, and accordingly no coating unevenness was developed on the coating film 33 in the coating widthwise direction. In Table 1, a negative sign attached to the height difference d indicates that the coating work surface 35 of the second downstream lip 26 is close to the web 21 than the coating work surface 34 of the first downstream lip 25. It is noted in Table 1 that H denotes the film thickness of the lower layer coating film in a dried condition, and F denotes the film thickness of the upper layer coating film in a dried condition.

In the above-mentioned embodiment, the second downstream lip 26 is moved, in the direction Y, toward and away from the web 21, relative to the first downstream lip 25 so as to change the height difference d between the downstream end X of the first downstream lip 25 on the coating work surface 34 and the upstream end of the second downstream lip 26 on the coating work surface 35. Accordingly, the web 21 is thereby displaced so as to set the ratio h/G between the gap G defined between the downstream end X of the first downstream lip 25 on the coating work surface 34 and the web 21, and the film thickness h of the lower layer coating film 33A which has been extruded from the first slot part 27, and which has not yet dried, to have the following relationship:

$$0.4<h/G<0.5$$

Figure 8:
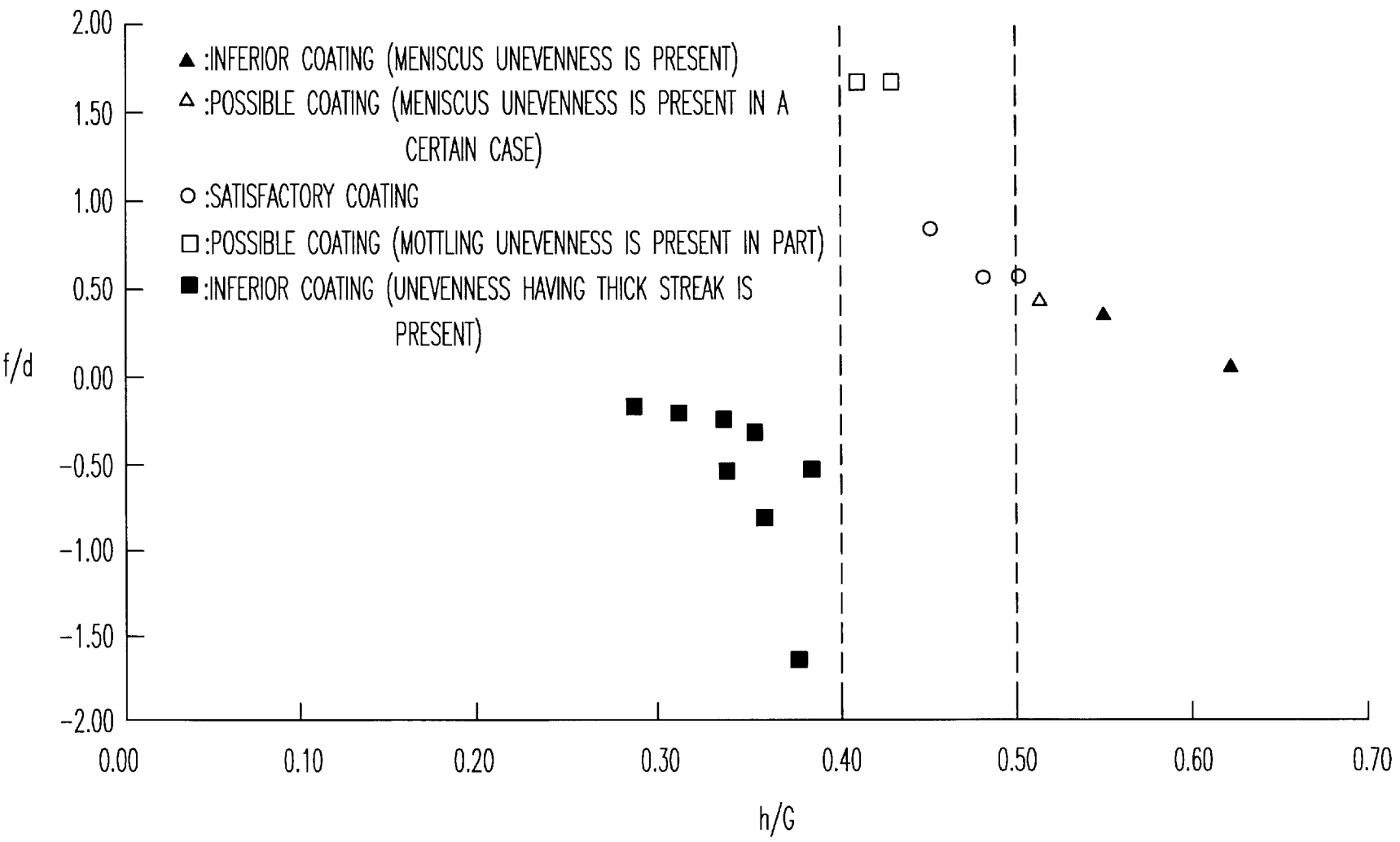
FIG. 8 is a graph showing a relationship between h/G and coating ability based upon the results of experiments summarized in Table 1 and 2.

Accordingly, the interface 36 between the lower layer coating film 33A and the upper layer coating film 33B of the multilayer structure coating film 33 coated on the web 21 is stabilized, and, as shown FIG. 8, it is possible to prevent development of coating unevenness on the coating film 33 in the coating widthwise direction. As a result, it is possible to provide a multi-layer structure coating film 33 having a satisfactory quality.

Second Embodiment

Figure 4:
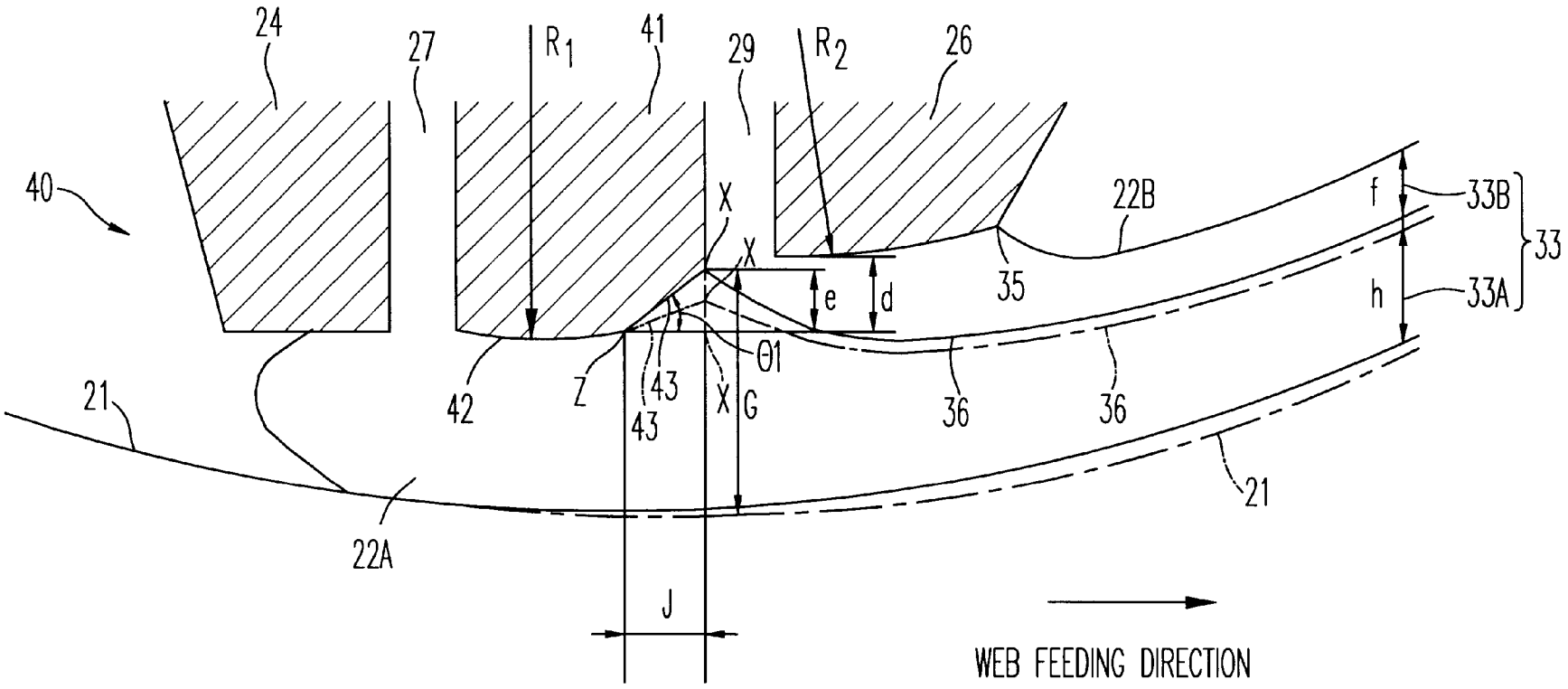
FIG. 4 is a sectional view illustrating a die head to which a second embodiment of a coating device adapted to be used in the coating method according to the present invention is applied, in a coating condition.
Figure 5:
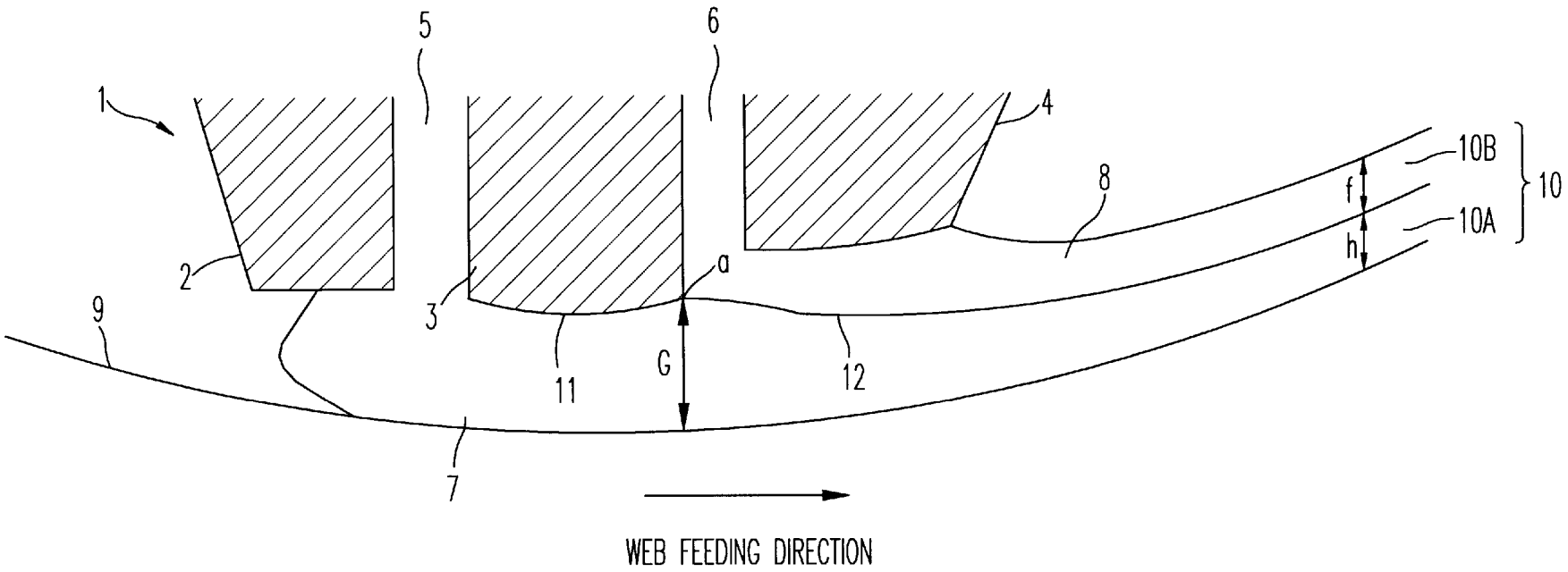
FIG. 5 PRIOR ART
FIG. 5 is a sectional view illustrating a die head in a coating device used in a conventional coating process.
Figure 6A:
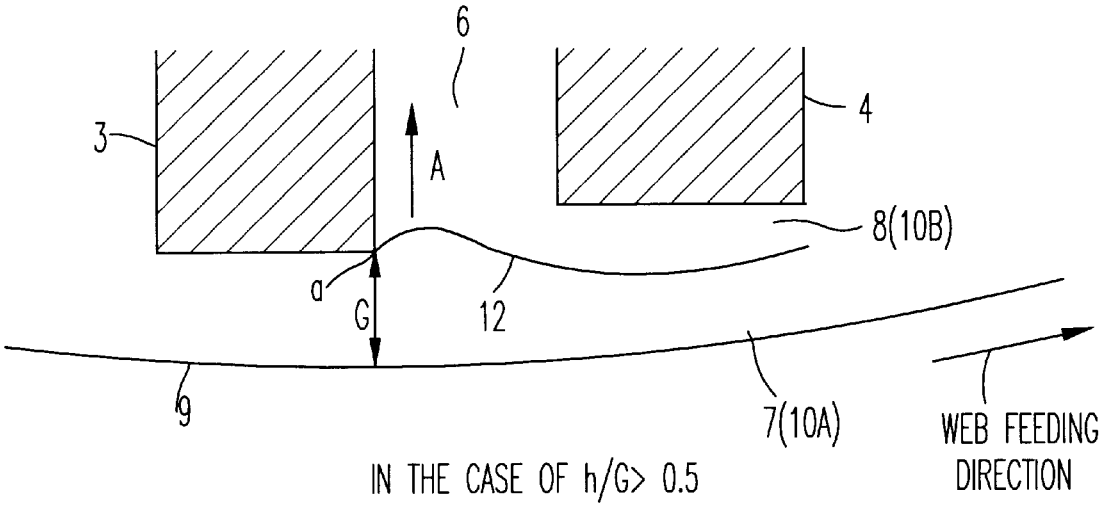
FIGS. 6A and 6B are sectional views illustrating the die head shown in FIG. 5 in a coating condition.
Figure 6B:
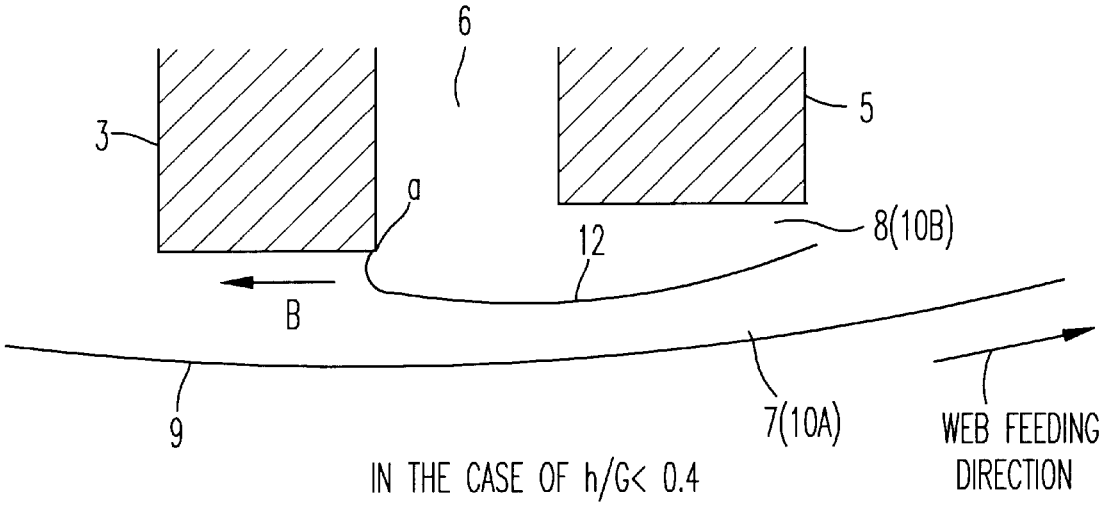

FIG. 4 is a sectional view showing a die head to which a second embodiment of the coating device used in a coating method according to the present invention is applied. In this second embodiment, like reference numerals denote like or similar parts to those explained in the first embodiment in order to abbreviate the explanation thereto.

In the coating device 40 in this second embodiment, a second downstream lip 26 of a die head 44 is not moved toward and away from the web 21 in the direction Y, but a cut-out surface 43 is formed in the downstream part of the first downstream lip 41 on the coating work surface 42. Usually, this cut-out surface 43 has a cut-out angle $\theta_1$ with respect to the web feeding direction, which is set to be less than 45 deg. By changing the cut-out height e of this cut-out surface 43, the gap G between the downstream end X of the first downstream lip 41 on the coating work surface 42 and the web 21 is directly changed so as to change the ratio h/G.

Table 2 shows the relationship between the cut-out surface 43 and the coating work surface 42 where the height difference d between the downstream end X of the first downstream lip 41, as defined where there is no cut-out surface 43 on the coating work surface 42, and the upstream end of the second downstream lip 26 on the coating work surface 35, is 5 $\mu$m, the radii R1, R2 of curvature of the arcuate surfaces of the coating work surfaces 42, 35 of the first downstream lip 41 and the second downstream lip 26 are 11 mm and 31 mm, respectively, the thicknesses of the upper and lower layer films of the coating film are 0.3 $\mu$m and 1.2 $\mu$m, respectively, the coating speed is 100 m/min, and a web projecting distance J between a cross-point Z of the cut-out surface 43 (when present) with the coating work surface 42 and the downstream end X is 100 $\mu$m. When the cut-out height e of the cut-out surface 43 is 1.0 $\mu$m. 2.0 $\mu$m, 3.0 $\mu$m, 4.0 $\mu$m or 5.0 $\mu$m, the ratio h/G is in a range from 0.40 to 0.51. In such a case, Table 2 shows that it has been found from actual experiments that the interface 36 between the lower layer coating film 33A and the upper layer coating film 33B is stabilized, and no coating unevenness is developed on the coating film 33 in the coating widthwise direction. Table 2 also shows that where no cut-out surface 43 is formed (that is, the cut-out height e is set to 0.0 $\mu$m) or the cut-out height e is set to 1.0 $\mu$m, meniscus unevenness is developed. Further, when the cut-out height is set to 6 $\mu$m, 7 $\mu$m or 8 $\mu$m, unevenness having thick streaks is developed in the coating direction.

In this coating device 40, the ratio h/G between the gap G defined between the downstream end X of the first downstream lip 41 on the coating work surface 42 and the web 21, and the film thickness h of the lower layer coating film 33A extruded from the first slot part 27 and which has not yet been dried, is set as follows:

$$0.4<h/G<0.5$$

and accordingly, as shown in FIG. 8, it is possible to prevent development of meniscus unevenness on the coating film 33, thereby it is possible to provide a multi-layer structure coating film having a satisfactory quality.

Figure 7:
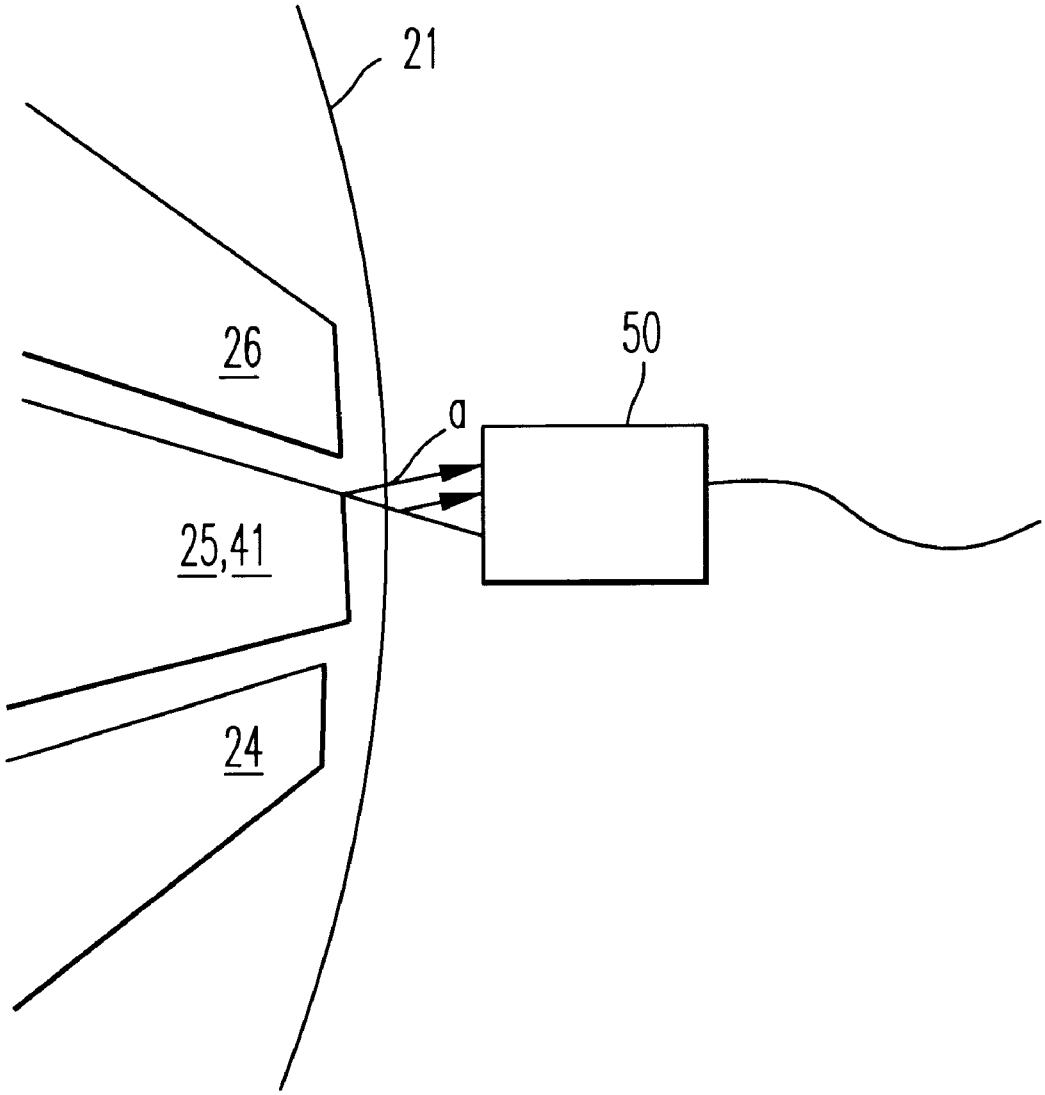
FIG. 7 is a view illustrating a measuring condition in which a gap between the lower end of the coating work surface of the first downstream lip and the web is measured.

It is noted that the distance G between the downstream end part X of the first downstream lip 25, 41 and the web 21 in the above-mentioned first and second embodiments can be measured by a laser displacement gage 50 as shown in FIG. 7. That is, the distance to the downstream end part X of the first downstream lip 25, 41 when the condition that the coating liquid 22A and the coating liquid 22B are not discharged from the die head 23, 44, and the web 21 does not cover the die lips 24, 25, 41, 26, and the distance to the web 21 in which the usual coating is carried out are considered, and a known thickness of the web 21 is combined therewith so that the distance G between the downstream end part X of the first downstream lip 25, 41 and the web 21 can be known.

It is noted that in the above-mentioned embodiments, it has been explained that the coating film 33 has two layers. However, the coating method according to the present invention can be applied to a coating device for forming a coating film having more than two layers. In this case, any of the lips other than lip 26 can be used for defining the gap G.

Thus, by the coating method according to the present invention, it is possible to prevent development of meniscus unevenness, whereby it is possible to provide a multi-layer structure coating film having a satisfactory quality.

The entire disclosure of Japanese Patent Application No. 8-114357 filed on Apr. 12, 1996 including specification, claims drawings and summary are incorporated herein by reference in its entirely.

Although the invention has been illustrated and described with respect to several exemplary embodiments, it should be understood by those skilled in the art that the foregoing and various other changes, omissions and additions may be made to the present invention without departing from the spirit and scope thereof. Therefore, the present invention should not be understood as limited to the specific embodiment set out above but to include all possible embodiments which can be embodied within a scope encompassed and equivalents thereof with respect to the feature set out in the appended claims.

TABLE 1

| Height Difference d [μm] | Upper Layer Coating Fiim F [μm] | Lower Layer Coating Fiim H [μm] | G [μm] | h/G | Surface Quality |
|---|---|---|---|---|---|
| 8 | 0.3 | 1.2 | 10.59 | 0.62 | ▲ |
| 5 | 0.3 | 1.2 | 12.00 | 0.55 | ▲ |
| 3 | 0.3 | 1.2 | 13.10 | 0.50 | ○ |
| 1 | 0.3 | 1.2 | 14.60 | 0.45 | □ |
| 0 | 0.3 | 1.2 | 14.97 | 0.44 | □ |
| −3 | 0.3 | 1.2 | 17.10 | 0.39 | ■ |
| −5 | 0.3 | 1.2 | 18.64 | 0.35 | ■ |
| −6 | 0.3 | 1.2 | 19.47 | 0.34 | ■ |
| −8 | 0.3 | 1.2 | 21.15 | 0.31 | ■ |
| −10 | 0.3 | 1.2 | 22.84 | 0.29 | ■ |

Note : As to the surface quality
▲ : Inferior Coating (Meniscus unevenness is present)
Δ : Possible Coating (Meniscus unevenness is present in a certain case)
○ : Satisfactory Coating
□ : Possible Coating (Mottling unevenness is present in part)
■ : Inferior Coating (Unevenness having thick streak is present)

TABLE 2

| Cut-Out e [μm] | Height Difference d [μm] | Upper Layer Coating Fiim F [μm] | Lower Layer Coating Fiim H [μm] | G [μm] | h/G | Surface Quality |
|---|---|---|---|---|---|---|
| 0 | 5 | 0.3 | 1.2 | 11.98 | 0.55 | ▲ |
| 1 | 4 | 0.3 | 1.2 | 12.82 | 0.51 | Δ |
| 2 | 3 | 0.3 | 1.2 | 13.69 | 0.48 | ○ |
| 3 | 2 | 0.3 | 1.2 | 14.60 | 0.45 | ○ |
| 4 | 1 | 0.3 | 1.2 | 15.53 | 0.43 | □ |
| 5 | 0 | 0.3 | 1.2 | 16.46 | 0.40 | □ |
| 6 | −1 | 0.3 | 1.2 | 17.41 | 0.38 | ■ |
| 7 | −2 | 0.3 | 1.2 | 18.384 | 0.36 | ■ |
| 8 | −3 | 0.3 | 1.2 | 19.36 | 0.34 | ■ |

Note : As to the surface quality
▲ : Inferior Coating (Meniscus unevenness is present)
Δ : Possible Coating (Meniscus unevenness is present in a certain case)
○ : Satisfactory Coating
□ : Possible Coating (Mottling unevenness is present in part)
■ : Inferior Coating (Unevenness having thick streak is present)

What is claimed as new desired to be secured by Letters patent of the United States is:

1. A coating method for coating a base material with coating liquid extruded from an extruder having an upstream lip, at least two downstream lips and slot parts defined between said lips for extruding coating liquid, said downstream lips each having coating work surfaces facing said base material, comprising the steps of:

relatively moving said extruder and said base material such that said base material relatively moves in a first direction from upstream to downstream while facing said coating work surfaces;

extruding coating liquid from said slot parts and onto said base material so as to form a coating film on said base material; and controlling at least one of said extruder and said base material such that a size of a gap, in a second direction transverse to the first direction, defined between said base material and said coating work surface of one of said downstream lips other than a downstream-most one of said downstream lips is non-constant alone at least a part of the length of said coating work surface, in which:

$$0.4<h/G<0.5$$

where,

G is the size of the gap defined between said base material and a downstream end of the coating work surface of the one of said downstream lips other than a downstream-most one of said downstream lips, and h is a thickness, in the second direction, of an undried layer of the coating liquid formed by the coating liquid held between the coating work surface with which said gap G is set and the base material, separated from said extruder.

2. The method of claim 1 wherein said controlling step comprises adjusting a height difference in said second direction between a downstream end of the coating work surface of said one of the downstream lips, and the upstream end of the coating work surface of a downstream lip which is located downstream in the feeding direction of the base material adjacent to said one of the downstream lips so as to displace the position of the base material in order to change the ratio h/G.

3. The method of claim 1, wherein the size of the gap is non-constant along the entire length of said coating work surface.

4. A coating method for coating a base material with coating liquid extruded from an extruder having an upstream lip, at least two downstream lips and slot parts defined between said lips for extruding coating liquid, said downstream lips each having coating work surfaces facing said base material, comprising the steps of:

relatively moving said extruder and said base material such that said base material relatively moves in a first direction from upstream to downstream while facing said coating work surfaces;

extruding coating liquid from said slot parts and onto said base material so as to form a coating film on said base material; and controlling at least one of said extruder and said base material such that:

$$0.4<h/G<0.5$$

where,

G is the size of a gap, in a second direction transverse to the first direction, defined between said base material and a downstream end of the coating work surface of a one of said downstream lips other than a downstream-most one of said downstream lips, and h is a thickness, in the second direction, of an undried layer of the coating liquid formed by the coating liquid held between the coating work surface with which said gap G is set and the base material, separated from said extruder, wherein said controlling step comprises adjusting a height position of the downstream end of the coating work surface of the one of said downstream lips other than a downstream-most one of said downstream lips by forming a cut-out at the downstream end of the coating work surface of the one of said downstream lips other than a downstream-most one of said downstream lips.

* * * * *